US005514933A

United States Patent [19]

Ward et al.

[11] Patent Number: 5,514,933

[45] Date of Patent: May 7, 1996

[54] PLASMA DISPLAY HEATER

[75] Inventors: Lester G. Ward; Howard M. Myers; Walter L. Baker, all of Greensboro; Benjamin T. Siler, Stokesdale, all of N.C.

[73] Assignee: Gilbarco Inc., Greensboro, N.C.

[21] Appl. No.: 191,584

[22] Filed: Feb. 3, 1994

[51] Int. Cl.[6] ..... H01J 7/24; G09G 3/10

[52] U.S. Cl. ..... 313/582; 313/15; 313/17; 313/484; 313/635; 445/24; 315/169.4

[58] Field of Search ..... 313/583, 582, 313/15, 17, 484, 634, 635; 445/24; 315/169.4

[56] References Cited

U.S. PATENT DOCUMENTS

| | | | |
|---|---|---|---|
| 3,811,060 | 5/1974 | Tsujimoto | 313/583 |
| 4,520,290 | 5/1985 | Cokefair . | |
| 4,550,039 | 10/1985 | Glaser et al. | 313/583 |
| 4,692,655 | 9/1987 | Person et al. . | |
| 4,730,139 | 3/1988 | Harvey . | |
| 4,956,573 | 9/1990 | Smith et al. . | |
| 4,956,577 | 9/1990 | Parker | 313/634 |
| 4,969,849 | 11/1990 | Smith et al. . | |

*Primary Examiner*—Sandra L. O'Shea
*Assistant Examiner*—Matthew J. Esserman
*Attorney, Agent, or Firm*—Rhodes Coats & Bennett

[57] ABSTRACT

A gas plasma display panel heater device for use with a gas plasma panel display, and methods for using and mounting the same. The gas plasma display panel has a display viewing area, external connection and heather. The gas plasma display heater device includes a thermally conductive layer, preferably a foil or coating, arranged and configured to substantially envelop the gas plasma display panel while not covering the display viewing area. The gas plasma display heater device is operative to conduct heat generated by the heater to other portions of the gas plasma display panel. The plasma display heater further includes a supplemental heater device. The supplemental heater device includes a heating element which is formed from an electrically resistive material such that, when a current is passed through the heating element, the same will generate heat. The supplemental heater also has electrical leads electrically connected with the heating element. The electrical leads are operable to conduct a current through the heating element. The heating element is mounted on a selected portion of the gas plasma display panel, preferably on or near the coldest portion thereof.

15 Claims, 2 Drawing Sheets

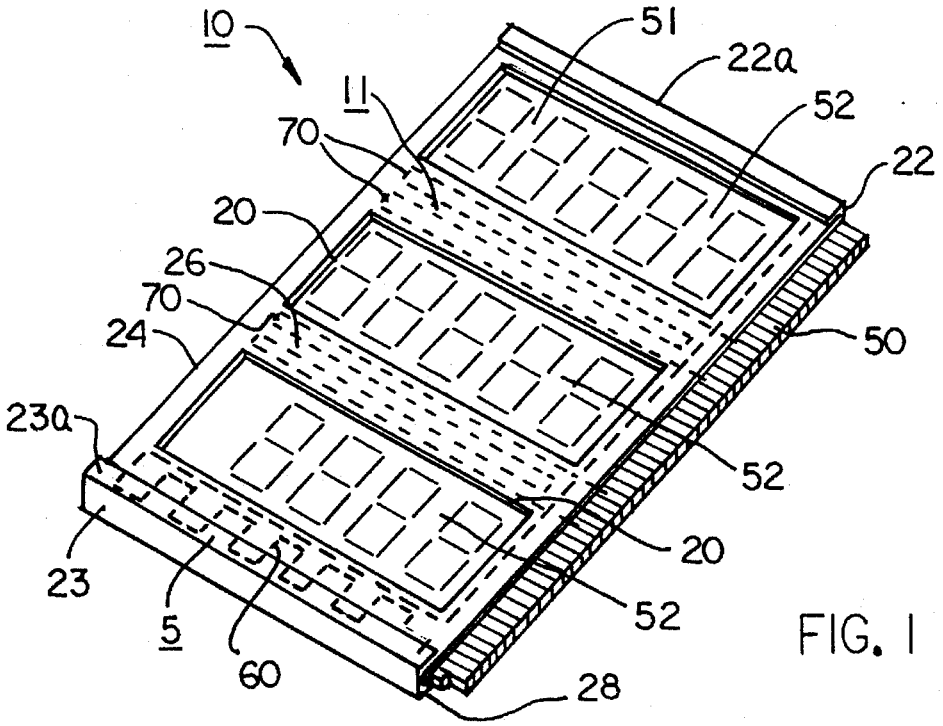
FIG. 1
FIG. 2
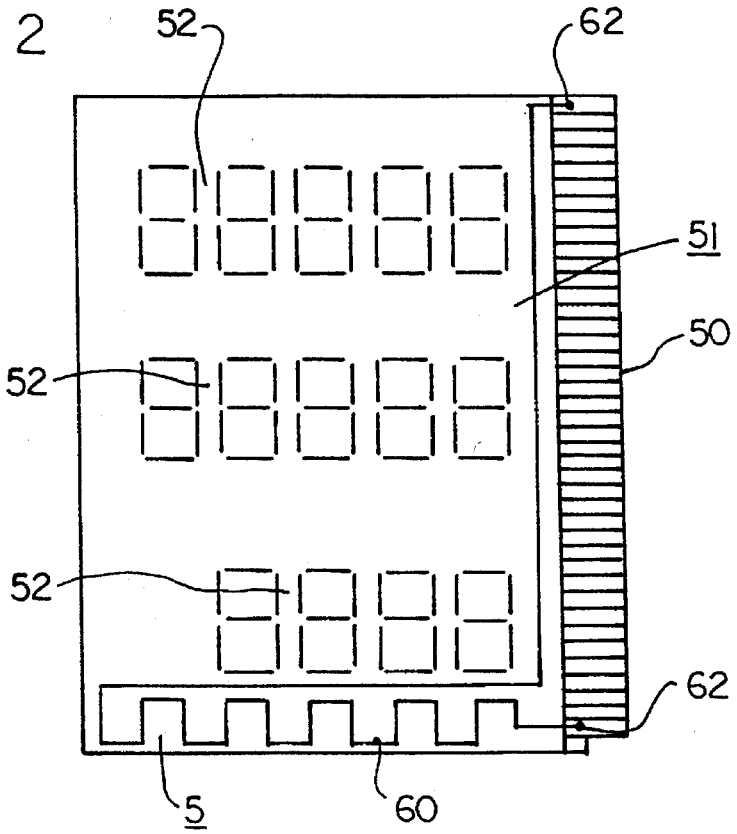

PLASMA DISPLAY HEATER

FIELD OF THE INVENTION

The present invention is directed to DC plasma displays and, more particularly, to a heater apparatus for maintaining uniform temperatures across a plasma display.

BACKGROUND OF THE INVENTION

Plasma display panels are widely used in applications such as gasoline dispensers. A conventional plasma display panel comprises a pair of glass panels which are sealed to form a chamber. The chamber contains selected ionizable gases, such as neon and/or argon, at low to sub-atmospheric pressures. Typically, anodes are located on the inside surface of the upper panel of the chamber and cathodes are located on the inside surface of the lower panel of the chamber. Producing an electric potential and current flow between a given anode and cathode causes the gas therebetween to ionize and glow. By strategically producing electric potentials between selected anode and cathode pairs, visible symbols may be displayed for viewing through the upper glass panel.

Mercury vapor is provided in the display chamber to inhibit sputtering. Sputter is a process in which the gas ions, propelled by the anode to cathode electrical potential, collide with and dislodge atoms from the cathode surface. These sputtered cathode atoms may deposit on the clear anode surface and build up a thick layer which will block the display's light output. Sputtering cathode atoms that become redeposited are often conductive (i.e. nickel cathodes), thus leading to electrical leakage paths or shorting inside the display. A third way that sputtering atoms can cause display failure is that the sputtered atoms, when they redeposit, may trap gas mixture atoms (i.e. gas cleanup). The reduction in pressure due to gas cleanup can further increase the rate of sputtering. Preferential cleanup of argon from a Penning Mixture can lead to a higher firing voltage. If the display's power supply cannot produce this higher voltage, the display will fail to light.

One widely recognized problem with plasma displays as described above involves condensation of the mercury vapor at low temperatures. In outdoor applications such as gasoline dispensers, ambient temperature can be as low as–30° C. When the mercury condenses, there is a reduction in the amount of mercury vapor. Mercury condensation has other potential damaging effects which are well-known and will not be detailed herein.

Several display heater configurations have been developed to impede or prevent mercury condensation.

U.S. Pat. No. 4,956,573 to Smith et al. discloses a gas discharge display which includes a heater element that is built into the unit. The heater element is coplanar with the cathode electrode of the display. A single set of parallel conductive pins is used to provide the connection to the anode, cathode and heater element components of the display.

U.S. Pat. No. 4,520,290 to Cokefair discloses a gas discharge display in which a heater is built into the unit. A single set of parallel conductive pins provide the connections for the unit's anode, cathode and heater strip.

U.S. Pat. No. 4,730,139 to Harvey discloses a gas display panel having a base plate carrying cathode electrodes and a face plate carrying anode electrodes, the base plate and face plate being hermetically sealed together to form an envelope which is filled with an ionizable gas and mercury vapor. The base plate carries a conductor which is used to heat the panel and this conductor extends over the surface of the base plate into the areas of the seal between the base plate and face plate. The base plate also is positioned to provide heat at the location where a source of mercury is coupled to the base plate.

U.S. Pat. No. 4,692,655 to Person et al. discloses a gas discharge display device comprising upper and lower substrates having anodes and cathodes thereon. An envelope is formed between the upper and lower substrates and includes an ionizable gas therein. A resistance heater element is placed on the lower substrate adjacent the cathode, and a layer of dielectric material is printed over both the cathode and the heater. The heater includes a pair of trimming elements which extend parallel to one another and which may be connected at any one of a plurality of points along their length to achieve the desired trimmed resistance value for the heater element.

The heater configurations of the prior art have significant drawbacks. Gas plasma display heaters utilizing externally, rear-mounted heater elements and built-in heater elements have been found to be insufficient to adequately maintain the temperature throughout the display panels. This is because the glass that forms the panel is a poor heat conductor and therefore heat applied to the back of the rear panel is not efficiently transferred to the chamber and the front panel. The undesirable heat transfer profile is further compounded by the fact that, in gasoline dispenser applications, the front panel is exposed to significant convective and radiative cooling. The heated plasma display panels of the prior art which utilize built-in heating elements (that is, the elements are disposed between the glass panels) cannot be cost effectively retrofitted to existing plasma displays. Furthermore, on displays having the heater elements and the cathode on the same layer, the heater elements cannot be located over the entire backside of the display due to physical interferences. As a result of the aforementioned drawbacks of the prior art plasma display heaters, the extremities of plasma displays utilizing such heater configurations in extreme temperatures are often 50° C. cooler than portions that are near the heating elements.

Thus, there exists a need for a heater apparatus for plasma displays which is effective to maintain a substantially uniform temperature across a plasma display. Further, there exists a need for such a heater apparatus which is cost effective to manufacture and mount on a plasma display. In addition, there exists a need for a such a heater apparatus which can be cost effectively retrofitted to existing plasma displays. Also there exists a need for a heater apparatus having the above characteristics which works passively.

SUMMARY OF THE INVENTION

The present invention is directed to a gas plasma display panel heater device for use with a gas plasma panel display, the gas plasma display panel having a display viewing area, external connecting means, and heating means. The heater device includes a thermally conductive layer or material and a supplemental heater. The layer, preferably a foil or coating of a thermally conductive material, is designed to substantially envelop the gas plasma display panel while not covering the display viewing area and is operative to conduct heat generated by the heating means to other portions of the gas plasma display panel. The supplemental heater device includes a heating element. The heating element is formed from an electrically resistive material such that, when a current is passed through the heating element, it generates heat. The supplemental heater is provided with electrical leads which are electrically connected with the heating element The electrical leads are operable to conduct a current through the heating element. The supplemental heater may be mounted on the coldest portion of the gas plasma display panel, generally the lower portion.

In a preferred embodiment, the thermally conductive layer is configured and arranged to envelop substantially the entire gas plasma display panel except the display viewing area and the external connecting means of the gas plasma display panel. If the layer is a foil, it may be adhered to the surface of the display panel using adhesive. The layer may also be provided as a rigid housing or a coating, or any other suitable means thermally conduct heat over the display panel.

The invention also provides a method of heating a gas plasma display panel and a method of mounting a gas plasma display panel heater device onto a gas plasma display panel.

BRIEF DESCRIPTION OF THE DRAWINGS

The invention will be better understood after a reading of the following description of the preferred embodiment when considered with the drawings, in which:

FIG. 1 is a perspective view of the display heater of the present invention wherein the supplemental heater forming a part of the present invention is shown in dashed lines.

FIG. 2 is a plan view of the supplemental heater forming a part of the invention shown in conjunction with a conventional gas plasma display panel.

DESCRIPTION OF THE PREFERRED EMBODIMENT

Figure 3:
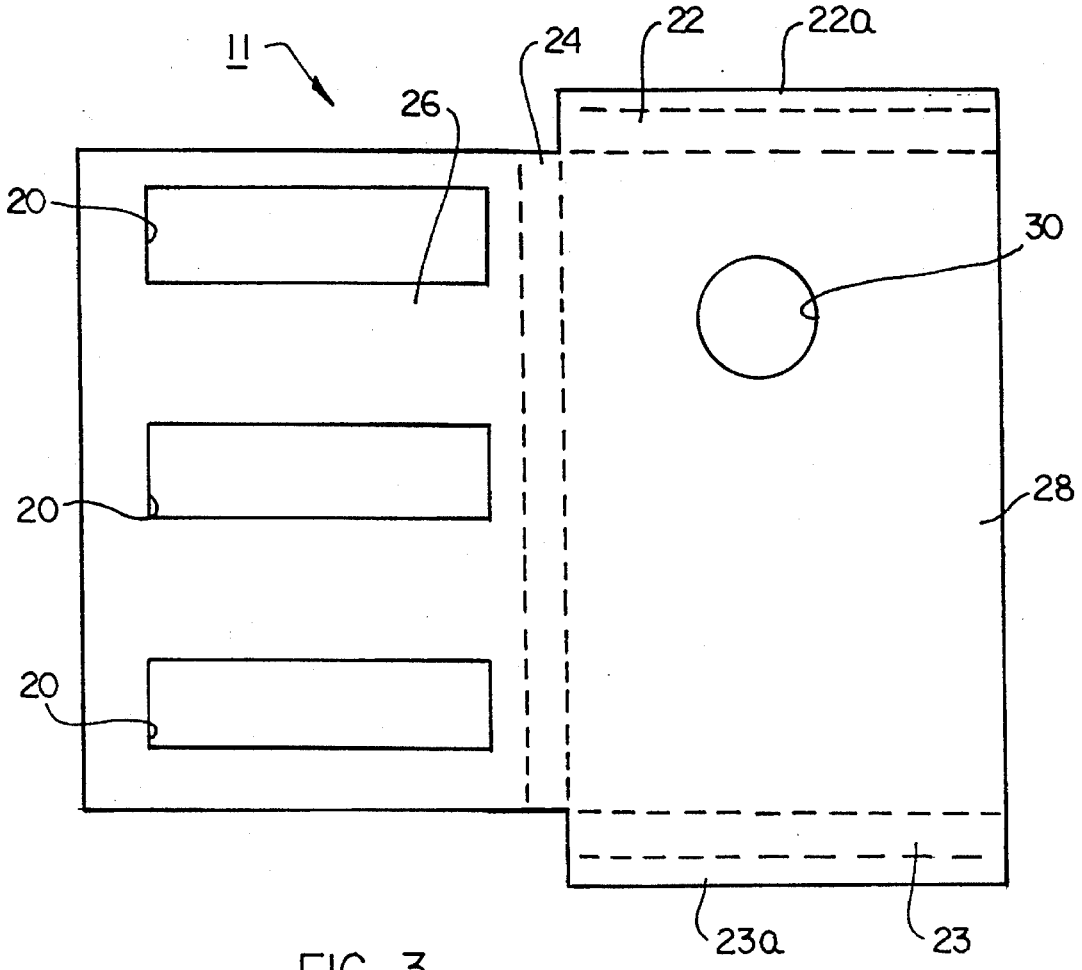
FIG. 3 is a plan view of the heater envelope forming a part of the present invention shown unfolded.

In the following description, like referenced characters designate like or corresponding parts throughout the several views. Also in the following description, it is to be understood that such terms as "forward", "rearward", "left", "right", "upwardly", "downwardly", "upper", "lower" and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto.

Referring now to the drawings and FIG. 1 in particular, the plasma display heater of the present invention, generally denoted by the numeral 10, is shown therein in conjunction with a conventional gas plasma display panel. The plasma display panel, generally denoted 51, includes a heading means 70 and may be of a type disclosed in the patents discussed in the background of the invention. Display panel 51 has display viewing areas 52 where the visual output of the display panel is displayed for observation. An array of pins 50 extends from the right side of display panel 51.

In a preferred embodiment plasma display heater 10 comprises two basic components: (1) a thermally conductive heater envelope, generally denoted 11; and (2) a supplemental heater, generally denoted 5.

Heater envelope 11 in FIG. 3 is shown unfolded. Heater envelope 11 may be a foil of unitary construction and formed of aluminum, copper or any suitable thermally conductive material. The heater envelope of the present invention may also be a thermally conductive paint or other coating. Envelope 11 may be a rigid housing as well. Preferably, heater envelope 11 is a foil, diecut into a suitable configuration and is formed from a ductile material. The configuration shown in FIG. 3 is suitable for a plasma display panel like the panel 51 shown in FIG. 1. Heater envelope 11 includes back panel 28 and front panel 26. Adjacent back panel 28 are upper side panel 22, lower side panel 23, upper side flap **22*a*, and lower side flap 23*a*. Access opening 30 is formed in back panel 28. Back panel 28 and front panel 26 are connected by left side panel 24. Front panel 26 has viewing area openings 20** formed therein. As will be appreciated, the exact size and shape of the envelope will be determined by the plasma display panel design.

If heater envelope 11 is a foil, it may be mounted on display panel 51 as follows. First, the internal surface (the surface which is shown in FIG. 3) is coated with adhesive. Any suitable adhesive may be used. Envelope 11 is then folded around display panel 51 such that openings 20 are positioned over display viewing areas 52, taking care to prevent the trapping of air bubbles between the foil and the display. Each of the side flaps 22,23,**22*a*, and 23*a* are then folded onto the corresponding surfaces of display panel 51. It will be understood that display panel 51 is now fully enveloped by heater envelope except for viewing areas 52, signal pins 50, and the area of display panel 51 which is adjacent access opening 30. Typically, the display tubulation nipple will extend from display panel 51 and out of access opening 30**.

When heater envelope 11 is positioned as described above, it forms a thermally conductive layer which substantially envelops the gas plasma display panel while not covering the display viewing area. Heater envelope 11 serves to conduct heat from the well-heated or overheated portions of display panel 51 to the underheated or highly cooled portions of display panel 51. As a result, the heat distribution across display panel 51 is more uniform in all directions than without envelope 11. Thus, heater envelope 11 maintains a more uniform temperature profile passively because no additional electricity or heat is needed.

If the heater envelope is a thermally conductive paint or coating, it may be applied using any suitable coating application method.

As best seen in FIGS. 1 and 2, supplemental heater 5 of the present invention is shown therein. Supplemental heater 5 includes continuous heating element 60, which is adhered to the top surface of plasma display panel 51, and electrical leads 62. Heating element 60 is formed from an electrically resistive material. Leads 62 are designed to operatively engage an electricity source for creating an electrical potential across heating element 60. In a preferred embodiment, the heater is a 5 watt heater. It will be understood that, when a current is passed through heating element 60, heating element 60 will generate heat.

FIG. 2 shows supplemental heater 5 as may be used without heater envelope 11. FIG. 1 shows supplemental heater 5 in dashed lines as it may be used in conjunction with heater envelope 11. In the preferred embodiment, heating element 60 is positioned between heater envelope 11 and plasma display 51 in order to take advantage of the heat distribution properties of envelope 11. It will be understood that heating element 60 may be mounted on the outer surface of heater envelope 11 as well. Heating element 60 is mounted on a selected portion of the display panel, preferably on or near the coldest portion thereof. As shown, heating element 60 is mounted on or near the lower portion of the display. This position is generally preferred because the lower portion of a conventional gas plasma display is generally the coldest. However, it will be appreciated that the optimal placement of the heating element will depend on the configuration of the display panel and its associated heater.

Certain modifications and improvements will occur to those skilled in the art upon a reading of the foregoing description. It should be understood that all such modifications and improvements have been deleted herein for the sake of conciseness and readability, and are properly within the scope of the following claims.

What is claimed is:

1. A gas plasma display panel heater device for use with a gas plasma display panel, the gas plasma display panel having a display viewing area, external connecting means, and heating means, comprising:

a thermally conductive layer, said layer being arranged and configured to substantially envelop the gas plasma display panel while not covering the display viewing area and operative to conduct heat generated by the heating means to other portions of the gas plasma display panel.

2. The gas plasma display panel heater device of claim 1 wherein said thermally conductive layer is arranged and configured to envelop substantially the entire gas plasma display panel except the display viewing area and the external connecting means of the gas plasma display panel.

3. The gas plasma display panel heater device of claim 1 wherein said thermally conductive layer is a thermally conductive foil.

4. The gas plasma display panel heater device of claim 3 further including adhesive operable to adhere said foil to the surface of the gas plasma display panel.

5. A gas plasma display panel heater device for use with a gas plasma panel display, the gas plasma display panel having a display viewing area, external connecting means, heating means and a lower portion, comprising:

a thermally conductive aluminum foil, said foil being arranged and configured to substantially envelop the gas plasma display panel while not covering the display viewing area and operative to conduct heat generated by the heating means to other portions of the gas plasma display panel; and a supplemental heater device, comprising:

(a) a heating element, said heating element being formed from an electrically resistive material such that, when a current is passed through said heating element, the same will generate heat, (b) electrical leads electrically connected with said heating element, said electrical leads being operable to conduct a current through said heating element, and (c) said heating element being mounted on a lower at side portion of the gas plasma display panel.

6. The gas plasma display panel heater device of claim 5 wherein said thermally conductive foil is designed to envelop substantially the entire gas plasma display panel except the display viewing area and the external connecting means of the gas plasma display panel.

7. The-gas plasma display panel heater device of claim 5 further including adhesive operable to adhere said foil to the surface of the gas plasma display panel.

8. A heated gas plasma display panel device, comprising:

a gas plasma display panel, said gas plasma display panel having a display viewing area, external connecting means, and heating means; and a thermally conductive foil, said foil being arranged and configured to substantially envelop said gas plasma display panel while not covering said display viewing area and operative to conduct heat generated by said heating means to other portions of said gas plasma display panel.

9. The heated gas plasma display panel device of claim 8 wherein said thermally conductive foil is arranged and configured to envelop substantially the entirety of said gas plasma display panel except said display viewing area and said external connecting means of said gas plasma display panel.

10. The heated gas plasma display panel device of claim 8 wherein said thermally conductive layer is a thermally conductive foil and further including adhesive operable to adhere said foil to the surface of said gas plasma display panel.

11. A method of heating a gas plasma display panel, the gas plasma display panel having a display viewing area, external connecting means, and heating means, comprising the steps of:

substantially enveloping the gas plasma display panel with a thermally conductive layer such that the display viewing area is not covered; and conducting heat from the heating means to other portions of the display panel through said thermally conductive layer.

12. The method of claim 11 further including applying a current through an electrically resistive heating element of a supplemental heater device such that the same generates heat.

13. A method for mounting a gas plasma display panel heat conductor onto a gas plasma display panel having a display viewing area, external connecting means, and heating means, comprising adhering the heat conductor in the form of a thermally conductive foil to the gas plasma display panel such that the substantial entirety of the surface of the gas plasma display panel is covered except the display viewing area and the external connecting means.

14. The method of claim 13 further including the step of mounting a supplemental heater to a selected portion on the gas plasma display panel.

15. The method of claim 14 wherein said step of mounting a supplemental heather precedes said of adhering the thermally conductive foil.

* * * * *

UNITED STATES PATENT AND TRADEMARK OFFICE

CERTIFICATE OF CORRECTION

PATENT NO. : 5,514,933

DATED : May 7, 1996

INVENTOR(S) : Lester G. Ward et al.

It is certified that error appears in the above-indentified patent and that said Letters Patent is hereby corrected as shown below:

On the title page, item [75] Inventor's Paul H. Smith and Reed B. McKissick should be listed as inventors.

Signed and Sealed this

Sixth Day of August, 1996

*Attest:*

Bruce Lehman

BRUCE LEHMAN

*Attesting Officer*

*Commissioner of Patents and Trademarks*